US007955183B2

(12) United States Patent
Burrows

(10) Patent No.: US 7,955,183 B2
(45) **Date of Patent: *Jun. 7, 2011**

(54) TEMPORARY GOLF CLUB SHAFT-COMPONENT CONNECTION

(75) Inventor: Bruce D. Burrows, Valencia, CA (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/718,781

(22) Filed: Mar. 5, 2010

(65) Prior Publication Data

US 2010/0160069 A1 Jun. 24, 2010

Related U.S. Application Data

(60) Continuation of application No. 11/612,072, filed on Dec. 18, 2006, now Pat. No. 7,704,158, which is a continuation of application No. 10/956,205, filed on Sep. 30, 2004, now abandoned, which is a division of application No. 10/623,054, filed on Jul. 17, 2003, now abandoned.

(60) Provisional application No. 60/398,548, filed on Jul. 24, 2002, provisional application No. 60/438,254, filed on Jan. 2, 2003, provisional application No. 60/438,040, filed on Jan. 2, 2003, provisional application No. 60/467,109, filed on Apr. 30, 2003.

(51) Int. Cl.
*A63B 53/02* (2006.01)

(52) U.S. Cl. ..... 473/288; 473/307; 473/309

(58) Field of Classification Search ..... 473/239, 473/288, 299, 305–313, 315, 296, 298
See application file for complete search history.

(56) References Cited

U.S. PATENT DOCUMENTS 1,019,657 A * 3/1912 Kerr ..... 279/93
1,266,529 A 5/1918 Mattern
1,623,523 A 4/1927 Bourke
(Continued)

FOREIGN PATENT DOCUMENTS

GB 392493 5/1933
(Continued)

OTHER PUBLICATIONS

U.S. Office Action related to U.S. Appl. No. 12/718,824 dated Aug. 2, 2010.

(Continued)

*Primary Examiner* — Stephen L. Blau
(74) *Attorney, Agent, or Firm* — Banner & Witcoff, Ltd.

(57) ABSTRACT

A temporary shaft-component connection for assembling a selected golf club shaft with a club head and/or hand grip segment, to facilitate custom club design and fitting to suit the needs and preferences of an individual golfer. The temporary shaft-component connection is particularly designed for use with nonmetallic club shafts formed from a graphite-based composite material or the like having a range of different lengths and stiffness (whip) characteristics. In a shaft-head connection, a metal adapter insert is mounted onto a lower end of the club shaft and includes one or more flat surfaces for reception into a matingly shaped socket in the hosel of a selected club head to prevent relative rotation between the club shaft and head. A compression nut carried on the shaft is threaded onto the hosel to axially engage and retain a thrust flange on the shaft or adapter or adapter insert, to prevent axial separation of the club head and shaft.

14 Claims, 8 Drawing Sheets

U.S. PATENT DOCUMENTS

| | | | | | |
|---|---|---|---|---|---|
| 1,634,082 | A | | 6/1927 | Rigby | |
| 1,792,852 | A | | 2/1931 | Mattern | |
| 1,850,843 | A | | 3/1932 | Lagerblade | |
| 2,067,556 | A | | 1/1937 | Wettlaufer | |
| 2,219,670 | A | | 10/1940 | Wettlaufer | |
| 2,451,262 | A | | 10/1948 | Watkins | |
| 2,464,850 | A | | 3/1949 | Crawshaw | |
| 3,206,206 | A | | 9/1965 | Santosuosso | |
| 3,516,697 | A | | 6/1970 | Hahn | |
| 3,524,646 | A | * | 8/1970 | Wheeler | 473/288 |
| 3,656,366 | A | | 4/1972 | Somero | |
| 3,848,737 | A | | 11/1974 | Kenon | |
| 3,891,212 | A | | 6/1975 | Hill | |
| 4,253,666 | A | | 3/1981 | Murphy | |
| 4,340,227 | A | | 7/1982 | Dopkowski | |
| 4,664,382 | A | * | 5/1987 | Palmer et al. | 473/288 |
| 4,948,132 | A | | 8/1990 | Wharton | |
| 4,984,794 | A | | 1/1991 | Pernelle et al. | |
| 5,165,688 | A | | 11/1992 | Schmidt | |
| 5,232,224 | A | | 8/1993 | Zeider | |
| 5,275,399 | A | | 1/1994 | Schmidt | |
| 5,275,408 | A | | 1/1994 | Desbiolles et al. | |
| 5,429,355 | A | | 7/1995 | Schmidt | |
| 5,433,442 | A | | 7/1995 | Walker | |
| 5,577,726 | A | | 11/1996 | Fenton | |
| 5,588,921 | A | * | 12/1996 | Parsick | 473/299 |
| 5,626,528 | A | | 5/1997 | Toulon | |
| 5,839,973 | A | | 11/1998 | Jackson | |
| 5,851,155 | A | | 12/1998 | Wood et al. | |
| 5,855,526 | A | | 1/1999 | Honma | |
| 5,906,549 | A | | 5/1999 | Kubica | |
| 6,095,929 | A | | 8/2000 | Clark | |
| 6,149,533 | A | * | 11/2000 | Finn | 473/336 |
| 6,203,443 | B1 | | 3/2001 | Britton | |
| 6,251,028 | B1 | | 6/2001 | Jackson | |
| 6,270,425 | B1 | | 8/2001 | Dyer | |
| 6,273,828 | B1 | | 8/2001 | Wood et al. | |
| 6,287,215 | B1 | | 9/2001 | Fisher | |
| 6,319,146 | B1 | | 11/2001 | Mills | |
| 6,332,945 | B1 | | 12/2001 | Lenhof | |
| 6,368,230 | B1 | | 4/2002 | Helmstetter et al. | |
| 6,447,404 | B1 | | 9/2002 | Wilbur | |
| 6,508,288 | B2 | | 1/2003 | Lenhof | |
| 6,547,673 | B2 | | 4/2003 | Roark | |
| 6,652,388 | B1 | | 11/2003 | Lenhof | |
| 6,669,573 | B2 | | 12/2003 | Wood et al. | |
| 6,797,106 | B2 | | 9/2004 | Lenhof | |
| 7,017,252 | B2 | | 3/2006 | Lenhof | |
| 7,083,529 | B2 | | 8/2006 | Cackett | |
| 7,115,046 | B1 | | 10/2006 | Evans | |
| 7,300,359 | B2 | | 11/2007 | Hocknell | |
| 7,326,126 | B2 | | 2/2008 | Holt | |
| 7,335,113 | B2 | | 2/2008 | Hocknell | |
| 7,344,449 | B2 | | 3/2008 | Hocknell | |
| 2008/0051211 | A1 | | 2/2008 | Hocknell | |
| 2008/0058114 | A1 | | 3/2008 | Hocknell | |
| 2008/0070717 | A1 | | 3/2008 | Hocknell | |
| 2008/0280693 | A1 | | 11/2008 | Chai | |

FOREIGN PATENT DOCUMENTS

| | | | |
|---|---|---|---|
| GB | 443439 | | 2/1936 |
| GB | 2331464 | | 5/1999 |
| JP | 2000024143 | | 1/2000 |
| JP | 2000157650 A | * | 6/2000 |
| JP | 2006042951 | | 2/2006 |
| WO | 9000424 | | 1/1990 |
| WO | 2007022671 | | 3/2007 |

OTHER PUBLICATIONS

European Search Report from European Patent Application No. 03748963.0, dated Apr. 7, 2008.

* cited by examiner

TEMPORARY GOLF CLUB SHAFT-COMPONENT CONNECTION

This application is a continuation of co-pending U.S. patent application Ser. No. 11/612,072 filed Dec. 18, 2006, which application is a continuation of U.S. patent application Ser. No. 10/956,205 filed Sep. 30, 2004 (now abandoned), which application is a divisional of U.S. patent application Ser. No. 10/623,054 filed Jul. 17, 2003 (now abandoned), which applications are based upon and claim priority to U.S. Provisional Patent Appln. No. 60/398,548 filed Jul. 24, 2002, U.S. Provisional Patent Appln. No. 60/438,254 filed Jan. 2, 2003, U.S. Provisional Patent Appln. No. 60/438,040 filed Jan. 2, 2003, and U.S. Provisional Patent Appln. No. 60/467,109 filed Apr. 30, 2003.

FIELD OF THE INVENTION

Background

This invention relates generally to improvements in golf clubs. More particularly, this invention relates to an improved temporary connection between a golf club shaft and an additional component such as a golf club head to facilitate customized golf club construction to suit the needs and preferences of an individual golfer.

Golf clubs are well known in the art, to include a club head such as a wood-type or iron-type club head mounted at a lower end of an elongated club shaft. An upper end of the club shaft has a resilient grip mounted thereon and designed for comfortable manual grasping and swinging of the golf club to strike a golf ball. In modern golf clubs, the wood-type or iron-type club head is commonly formed from a cast or machined metal or metal alloy such as stainless steel, titanium alloy, and the like. The club shaft has historically been formed from a selected metal or metal alloy, while more recent golf club designs have incorporated a nonmetallic club shaft formed from a composite material such as a graphite-based composite or the like. One advantage provided by such graphite-based composite club shaft materials is that the stiffness or flexibility (whip) characteristics of the club shaft can be variably selected in accordance with the preferences and skill level of an individual golfer. That is, by providing a golfer with a selection of club shafts having a range of different whip characteristics, the golfer can custom-tailor his or her set of golf clubs.

In the past, custom fitting of golf clubs having different physical characteristics, such as different club shaft stiffness and lengths, has required a golf shop to carry a large number of sample clubs for test use by golfers. More specifically, for each golf club head, it has been necessary for the golf shop to carry multiple sample club heads of each particular brand and type, each connected to a club shaft having different physical characteristics, for test use by golfers. For example, for any particular driver or other wood-type club head brand, or for any particular iron-type or putter club head brand, it has been necessary for the golf shop to carry a relatively large number of different sample clubs in order to provide a meaningful choice for custom-fitting of each golf club in accordance with the preferences of any one golfer. Heretofore, it has not been practical or feasible for club shafts and club heads to be interchanged quickly and easily. Accordingly, it has not been possible for a golfer to sample and test a large number of different club shaft-head combinations, without requiring the golf shop to carry an unduly large number of sample clubs. As a result, custom-fitting of golf clubs to an individual golfer generally has not provided the golfer with a truly broad selection of shaft-head combinations, and thus has not provided the golfer with an optimal choice for custom tailored clubs.

The resilient hand grip mounted on the upper end of a typical club shaft also comprises a variable in the design and custom fitting of golf clubs to suit the needs and preferences of an individual golfer. That is, resilient hand grips are available in a relatively broad range of different diametric sizes, tread patterns, and elastomer or other soft and compliant materials. The choice of hand grip size is dependent at least in part upon the size of the golfer's hands, with a larger grip diameter being normally preferred by a golfer having larger hands. Hand grip tread pattern and/or the softness or tackiness of the hand grip material may vary significantly in accordance with individual golfer preferences.

The present invention relates to a temporary shaft-head connection for quickly and easily interconnecting a selected golf club shaft with an additional component such as a selected golf club head or a selected hand grip segment, so that an individual golfer can be provided with an extensive range of shaft-component combinations for custom fitting of a set of golf clubs, without requiring a golf shop to carry an extremely large number of different sample golf clubs for test use.

SUMMARY OF THE INVENTION

In accordance with the invention, a temporary shaft-component connection is provided for quickly and easily assembling a selected golf club shaft with a selected golf club head and/or hand grip segment, to facilitate custom club design and fitting to suit the needs and preferences of an individual golfer. The temporary shaft-component connection is particularly designed for use with nonmetallic club shafts formed from a graphite-based composite material or the like having a range of different lengths and stiffness (whip) characteristics.

In one preferred form comprising a temporary shaft-head connection for coupling the golf club shaft to a golf club head, the shaft-head connection comprises a rigid and sturdy adapter insert mounted onto a lower end of the club shaft. The adapter insert includes one or more external flat surfaces formed from a low wear bearing material such as metal, such as a rectangular or squared-off or splined shape, for reception into a matingly shaped socket formed in the hosel or within an adapter socket mounted onto the hosel of a selected golf club head to prevent relative rotation between the club shaft and head. A compression nut carried on the club shaft or adapter insert is threadably connected to the hosel or adapter socket mounted thereto to axially engage and retain a thrust flange formed on the shaft or adapter, to prevent axial separation of the club head and shaft.

In one preferred form, the adapter insert has a sleeve-shaped construction and is securely affixed onto the lower end of the club shaft by means of epoxy or the like. In another preferred form, the adapter insert may comprise a drawn metal jacket or the like attached securely to the lower end of the club shaft. In a further preferred embodiment, the adapter insert may comprise a pin having an elongated shank seated into the lower end of a tubular club shaft, and an enlarged cap of flat-surfaced and noncircular cross section positioned at the shaft lower end for seated reception into the matingly shaped hosel socket or adapter socket. In each embodiment, the thrust flange can be provided as an integral portion of the adapter insert, or separately mounted by means of epoxy or the like onto the club shaft. In one configuration, the hosel socket is defined by the adapter socket mounted within a hosel bore, by means of epoxy or the like, wherein this adapter socket may further include external threads thereon for threaded engagement with the compression nut.

In another alternative preferred embodiment, the adapter insert further includes a tapered seat surface at a location axially above the flat surfaces thereon for seated friction fit into an upper end of the hosel socket as the compression nut is threaded onto the hosel. In this variation, a backstop flange may also be mounted onto the club shaft at a location axially above the compression nut. This backstop flange is engaged by the compression nut for axially retracting the club shaft from the hosel socket or adapter socket, upon unthreading movement of the compression nut to disassemble the club shaft from the club head.

In each embodiment, the club shaft is quickly and easily disassembled from the club head by unthreading the compression nut from the hosel or adapter socket, to retract or permit retracting of the adapter insert from the hosel or adapter socket. Alternately, the same temporary connection components may be used for interconnecting the club shaft with a hand grip segment having a selected hand grip thereon, to accommodate similar quick and easy assembly and disassembly of the golf club components. Such disassembly accommodates quick and easy re-assembly of the same club shaft with an alternative club head and/or hand grip segment having different physical characteristics, and/or reassembly of a different club shaft with the same club head and/or hand grip segment. In this manner, a golfer can test swing a large number of different shaft-head and shaft-grip segment combinations within a short period of time, for custom fitting of a set of golf clubs, without requiring the golf shop to carry a large number of sample clubs.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 2 is an enlarged fragmented and exploded perspective view illustrating components of the temporary shaft-head connection, in accordance with one preferred form of the invention;

DETAILED DESCRIPTION OF THE PREFERRED EMBODIMENTS

Figure 1:
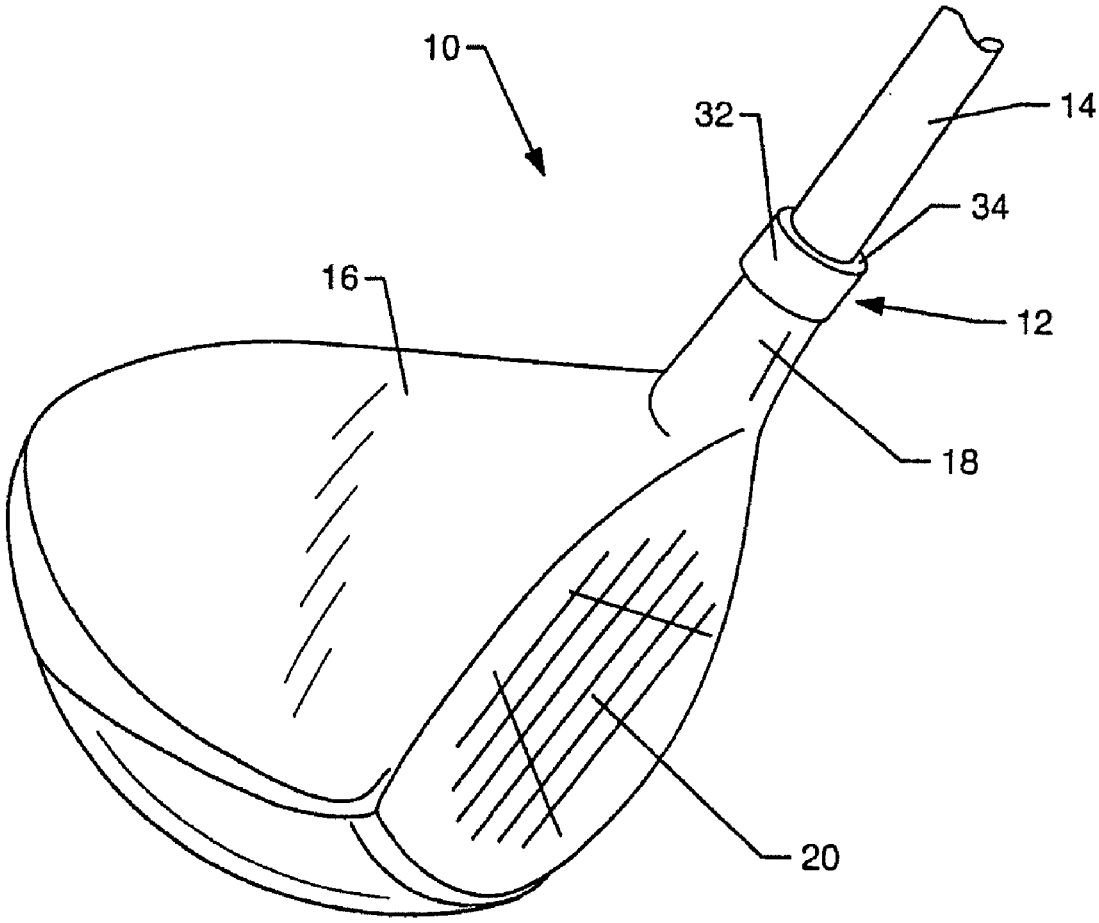
FIG. 1 is a perspective view of a golf club including a wood-type club head connected to the lower end of a golf club shaft by means of the temporary shaft-head connection in accordance with the present invention.
Figure 3:
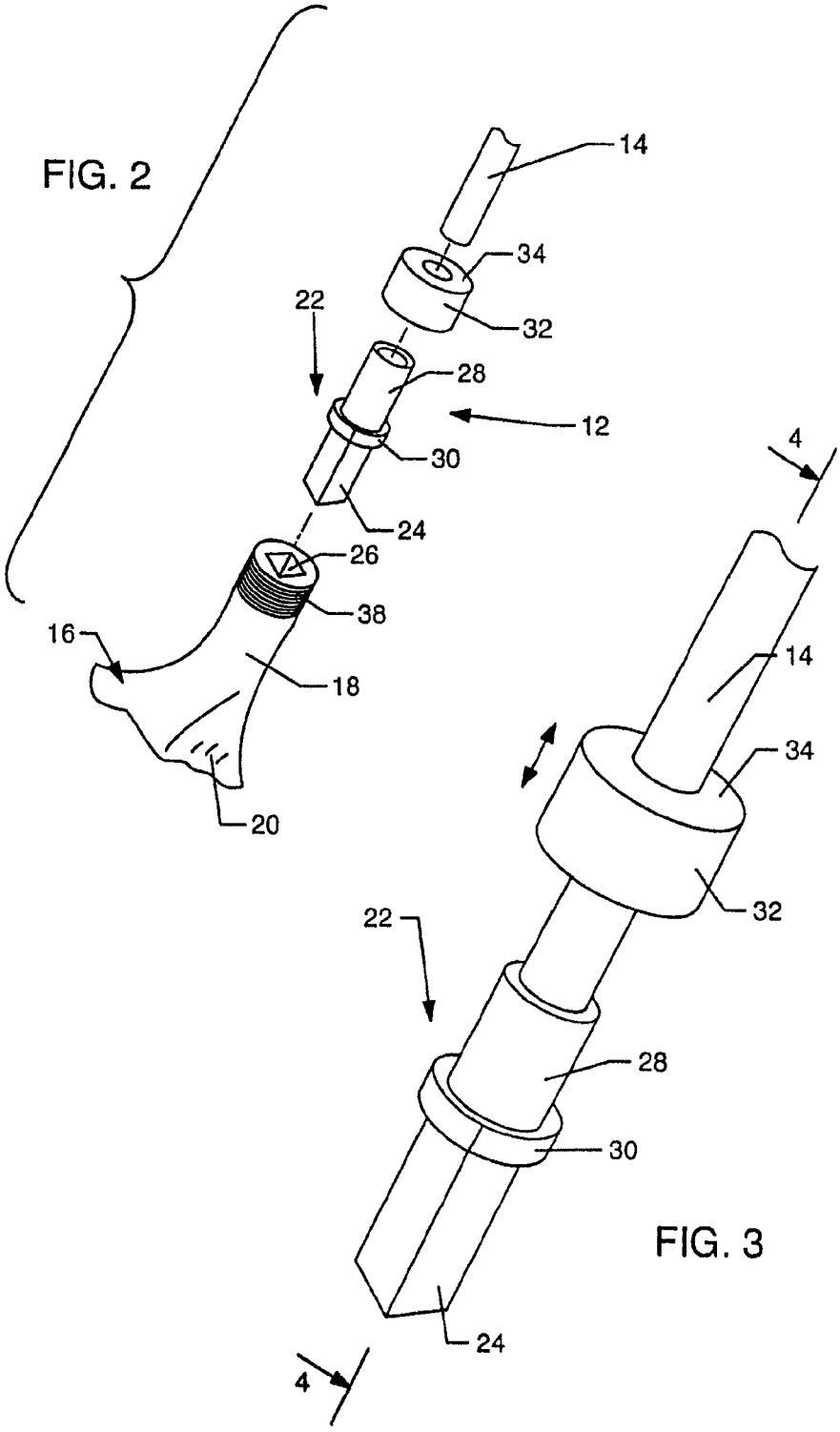
FIG. 3 is an enlarged fragmented perspective view showing partial assembly of the temporary connection components shown in FIG. 2.
Figure 4:
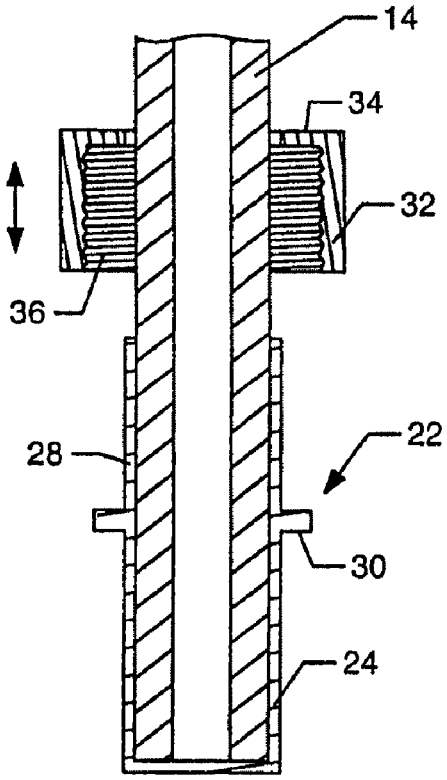
FIG. 4 is a fragmented longitudinal sectional view taken generally on the line 4-4 of FIG. 3.
Figure 5:
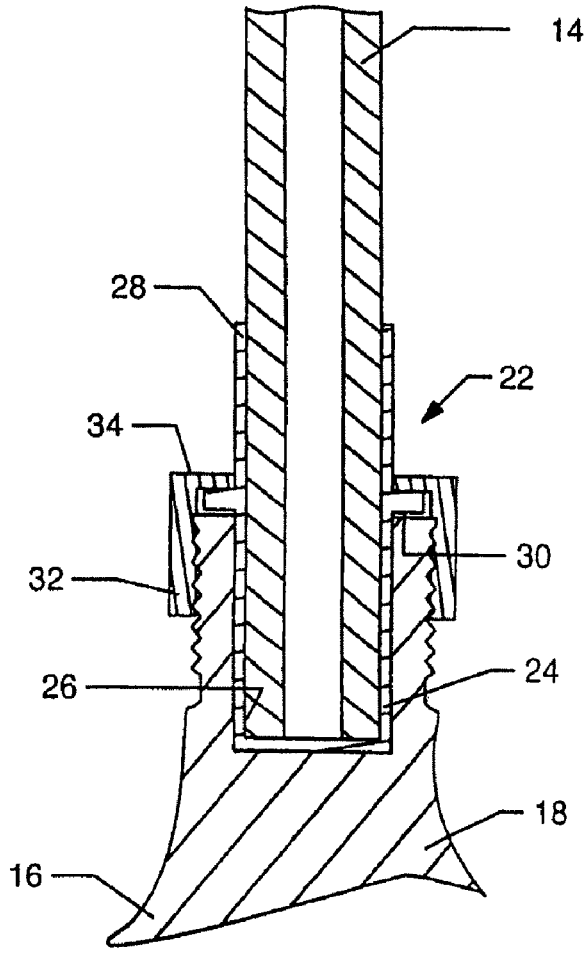
FIG. 5 is a fragmented sectional view similar to FIG. 4, but depicting the golf club shaft connected to the golf club head.

As shown in the exemplary drawings, a golf club referred to generally in FIG. 1 by the reference numeral 10 is provided with an improved temporary shaft-component connection 12 for quickly and easily interconnecting an elongated club shaft 14 with an additional component such as a golf club head 16. The temporary shaft-component connection 12 permits quick and easy assembly and disassembly of the club shaft 14 and additional component such as the head 16, so that a golfer can test swing a relatively large number of different golf club combinations within a relatively short period of time, and without requiring a golf shop to carry an unduly large number of sample clubs. The invention thus permits and facilitates custom fitting of a set of golf clubs from a selection of different club shafts and additional components such as club heads and/or hand grip segments having different physical characteristics, to suit the needs and preferences of an individual golfer.

The illustrative golf club 10 shown in FIG. 1 has an overall, generally conventional construction to include the elongated club shaft 14 connected to the club head 16 by interfitting a lower end of the club shaft 14 with a hosel 18 formed to extend generally upwardly from a heel end of the club head 16. In this regard, FIG. 1 shows the club head 16 in the form of a wood-type club head having a front ball impact face 20 for striking a golf ball (not shown). In accordance with modern golf club construction, the wood-type head 16 typically comprises a so-called metal wood club head comprising a hollow head construction formed from a selected cast or forged or machined metal or alloy such as stainless steel, titanium alloy, etc. Alternative club head types such as iron-type heads, putters, and the like may be used.

The club shaft 14 has an elongated and typically hollow tubular construction extending from the connection thereof to the club head 16 to an upper end (not shown) having a resilient grip (also not shown) mounted thereon. In many modern golf clubs, the club shaft 14 is formed from a nonmetallic material such as a carbon or graphite-based composite or the like, commonly referred to as a "graphite" shaft, which can be manufactured within a range of different physical characteristics such as length, and stiffness or flexibility (whip) to suit the needs and preferences of an individual golfer. In this regard, in the course of custom fitting a set of golf clubs to a particular golfer, it is common for the golfer to choose a club shaft 14 having specific and preferred physical characteristics from among a number of different club shafts having different physical characteristics, such as overall size, weight and weight distribution, head material, etc. In the same fashion, it is common for the golfer to choose a hand grip from among a number of different available hand grips formed, for example, with different diametric sizes, or from different cushioned materials or the different specific tread patterns.

In general terms, the temporary shaft-component connection 12 of the present invention is provided to permit and facilitate golfer selection of preferred shaft-component combinations in the course of custom fitting one or more golf clubs to an individual golfer. The temporary connection 12 is designed to enable quick and easy assembly of a specific shaft-head combination for golfer testing, and/or a specific shaft-grip segment combination for golfer testing, followed by quick and easy disassembly and subsequent re-assembly to form different shaft-component combinations. Accordingly, with the present invention, a golfer can test swing a relatively large number of different shaft-component combinations within a relatively short period of time, and without requiring a golf shop to carry an extremely large number of different sample clubs. Instead, the golf shop need only carry a single set of club shafts 14 having the range of different physical characteristics, and a single set of club heads 16 to include, for example, a set of so-called wood-type heads and a set of so-called iron-type heads, and one or more putter heads, etc., and a single set of grip segments having different physical characteristics. In each shaft-component combination assembled by use of the temporary connection 12 of the present invention, the club shaft 14 is securely attached to the additional component such as a club head 16 in a manner permitting actual club swinging and testing by striking a golf ball.

The temporary shaft-component connection 12 is shown in more detail in the accompanying drawings, which illustrate the invention for use in detachably coupling a selected club shaft 14 with a selected golf club head 16. Persons skilled in the art will recognize and appreciate, however, that the illustrative embodiments for a shaft-head connection may be used alternately or in addition to form a shaft-grip segment connection.

In accordance with one preferred form of the invention as depicted in FIGS. 2-5, the lower end of the club shaft 14 particularly such as a graphite shaft has a generally round cross sectional shape and is slide-fit received into the open upper end of a sleeve-shaped adapter insert 22. This adapter insert 22 is formed from a suitable rigid or sturdy bearing material, preferably such as stainless steel or the like, and is securely affixed onto the shaft lower end by means of a conventional epoxy or other suitable adhesive connection or the like.

The sleeve-shaped adapter insert 22 has a lower end or tip 24 defining an external flat-surfaced shape including at least one and preferably multiple flat surfaces, such as the generally rectangular or squared-off cross sectional shape as shown. The specific flat-surface geometry of the adapter tip 24 is sized and shaped for mating slide-fit and seated reception into a socket member defining an open socket 26, shown best in FIG. 2 in the form of a squared-off configuration, formed integrally by the hosel 18. Accordingly, when the tip 24 of the adapter insert 22 is seated within the hosel socket 26, the resultant interengaging flat surfaces prevent relative rotation between the club shaft 14 and the club head 16. Alternative noncircular shapes for the adapter tip 24 and the mating socket 26, particularly such hexagonal shapes or splined configurations, will be recognized and understood by persons skilled in the art.

The illustrative adapter insert 22 further includes an upper and generally cylindrical end portion 28 for slide-fit reception about the club shaft 14, with the tip 24 and upper end 28 portions of the adapter providing an internal extended surface area for secure mounting of the adapter insert onto the shaft 12 by epoxy or the like, as previously described. In addition, a radially outwardly projecting thrust flange 30 is formed on the adapter insert 22, generally at the juncture between the lower tip 24 and the upper end portion 28. This thrust flange 30 is positioned to seat generally upon a thrust seat defined by the axial upper end of the hosel 18, when the adapter tip 24 is seated within the hosel socket 26. A compression nut 32 is carried about the club shaft 14 and can be slidably displaced downwardly over the thrust flange 30, to bring a thrust shoulder 34 on the nut 32 into axially bearing engagement with the thrust flange 30, for securely retaining the thrust flange 30 engaged with the thrust seat. At the same time, a female thread 36 (FIG. 4) within the compression nut 32 is engaged with a male thread 38 (FIG. 2) on the hosel 18 to prevent axial separation of the club shaft 14 from the club head 16.

A selected club shaft 14 having a particular set of physical characteristics is thus assembled quickly and easily with a selected club head 16. The flat-surfaced tip 24 of the adapter insert 22 engages the matingly shaped hosel socket 26 to prevent relative rotation between the club shaft 14 and head 16, with the hard and flat-surfaced adapter tip 24 providing the requisite and adequate torque load-bearing capacity which would not otherwise be provided by forming one or more flat surfaces directly upon the graphite club shaft material. In addition, the compression nut 32 firmly seats and retains the thrust flange 30 on the thrust flange, relative to the hosel 18 to prevent axial separation of the components. The resultant shaft-head combination can be tested by a golfer under actual swing and ball impact conditions. The particular shaft-head combination can then be disassembled quickly and easily, followed by quick and easy re-assembly of the club head with an alternative club shaft having different physical characteristics, and/or reassembly of the club shaft with a different club head.

Figure 6:
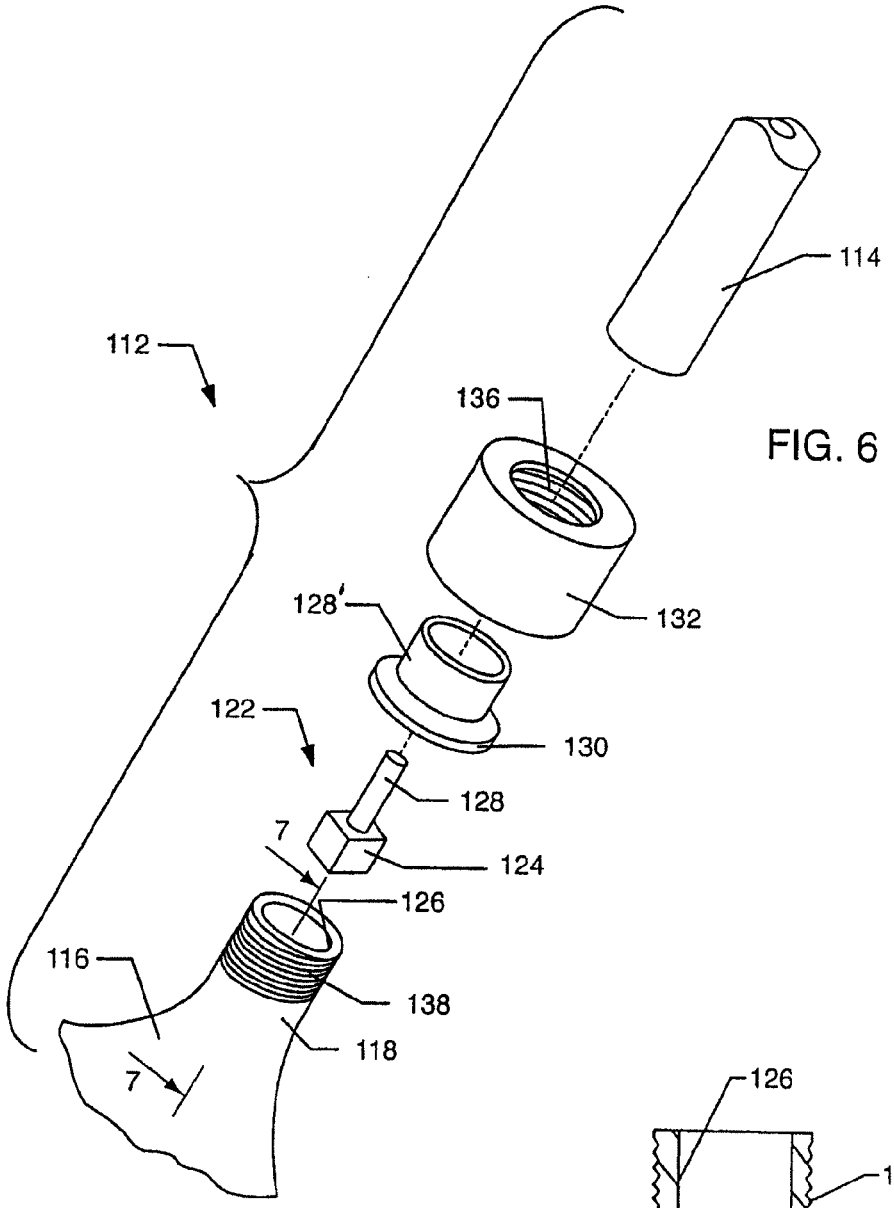
FIG. 6 is a fragmented and exploded perspective view illustrating an alternative preferred form of the invention.
Figure 7:
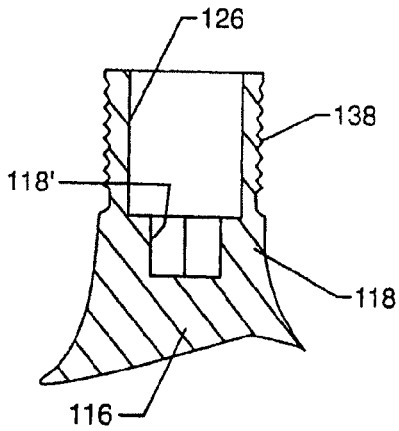
FIG. 7 is a fragmented longitudinal sectional view of a hosel portion of the club head taken generally on the line 7-7 of FIG. 6.
Figure 8:
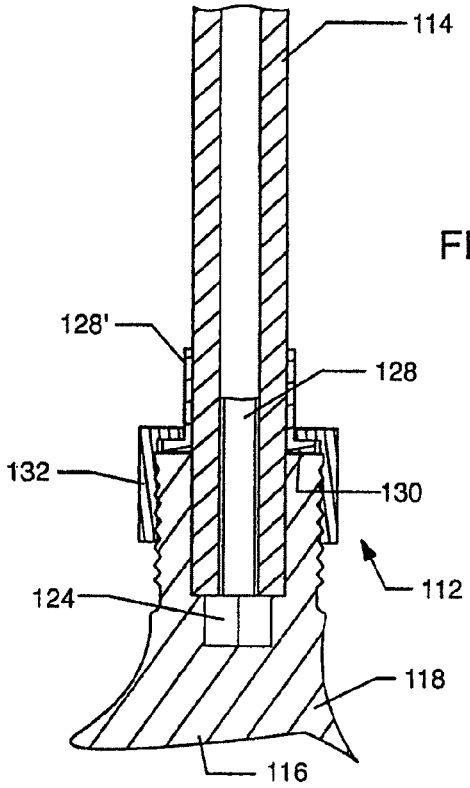
FIG. 8 is a fragmented longitudinal sectional view showing the embodiment of FIG. 6 with the golf club shaft connected to the golf club head.

FIGS. 6-8 illustrate one alternative preferred form of the invention, wherein components corresponding functionally to those shown in FIGS. 1-5 are identified by common reference numerals increased by 100. As shown, the illustrative club head 116 has a hosel 118 upstanding generally at a heel end thereof, wherein this hosel 118 defines an upwardly open hosel socket 126 having a conventionally round cross section shape but further including a base segment 118' in the form of a flat-surfaced counterbore such as the squared-off geometry as depicted in FIG. 7. A male thread 138 is formed about the hosel 126.

The lower end of the tubular club shaft 114 carries a pin-shaped adapter insert 122 having an elongated pin shank 128 received into the hollow shaft bore and suitably fastened therein as by means of an epoxy or the like. Alternatively, the pin shank 128 can be threaded for secure thread-in attachment into the shaft bore. In either case, the pin-shaped adapter insert 122 further includes a cap 124 having a flat-surfaced geometry such as a squared-off shape that is sized for mating slide-fit into the flat-surfaced base segment 118' of the hosel socket 126. In this position, a thrust flange 130, mounted securely onto the club shaft 114 as by an axially elongated thrust collar 128' which is affixed to the club shaft by means of an epoxy or the like, is seated upon the axially upper end of the hosel 118. A compression nut 132 having an internal female thread 136 is threadably engaged with the hosel 118 in the same manner as previously described, for axially retaining the thrust flange 130 relative to the club head 116.

The thus-described temporary shaft-head connection 112 (FIGS. 6-8) thereby provides for quick and easy shaft-head assembly for golfer testing, and corresponding quick and easy disassembly so that the golfer can test other shaft-head combinations. The flat-surfaced cap 124 of the adapter insert 122 engages the flat-surfaced base segment 118' of the hosel socket 126 to prevent shaft-head rotation, and the compression nut 132 retains the thrust flange 130 to prevent axial component separation.

Figure 9:
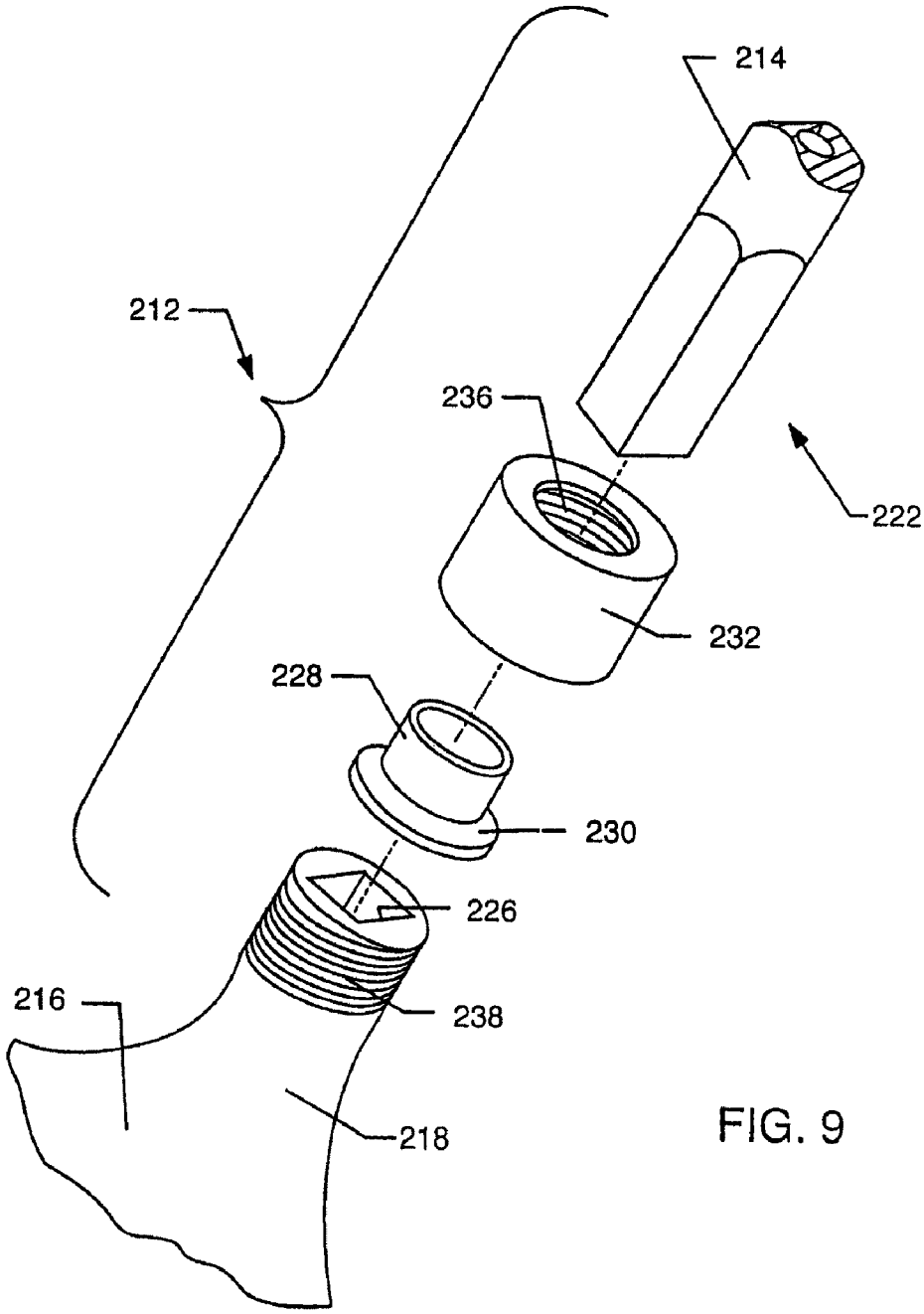
FIG. 9 is a fragmented and exploded perspective view illustrating another alternative preferred form of the invention.
Figure 10:
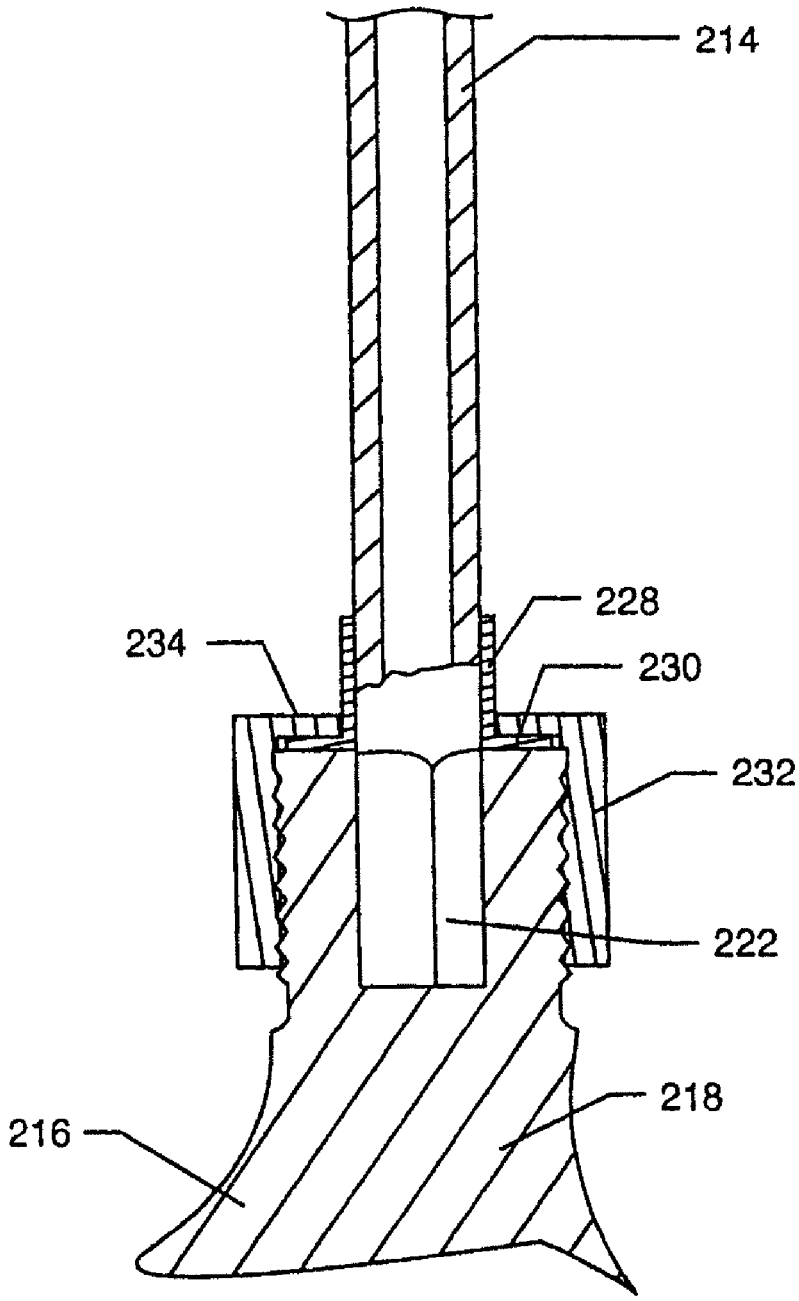
FIG. 10 is a fragmented longitudinal sectional view showing the embodiment of FIG. 9 with the golf club shaft connected to the golf club head.

A further alternative preferred form of the invention is shown in FIGS. 9-10, wherein components corresponding functionally to those shown in FIGS. 1-5 are identified by common reference numerals increased by 200. As shown, the illustrative club head 216 has a hosel 218 upstanding generally at a heel end thereof, wherein this hosel 218 defines an upwardly open hosel socket 226 as previously shown and described with respect to FIGS. 1-5.

In this embodiment, the adapter insert 222 comprises a jacket formed by drawn metal or the like encasing and securely attached to the lower end of the club shaft 214, and further defining the flat-surfaced external geometry such as the squared-off shape as shown. The drawn metal jacket adapter insert 222 is sized and shaped for mating slide-fit reception into the hosel socket 226 to prevent relative rotation between the shaft 214 and the club head 216. A thrust flange 230 is formed integrally with an axially elongated thrust collar 228 which is affixed to the club shaft by means of an epoxy or the like, and is seated upon the axially upper end of the hosel 218. A compression nut 232 having an internal female thread 236 is threadably engaged with the male thread 238 on the hosel 218 in the same manner as previously described, for axially retaining the thrust flange 230 relative to the club head 216 and thereby preventing axial shaft-head component separation. In use, the resultant temporary shaft-head connection 212 functions in the same manner as previously described herein.

Figure 11:
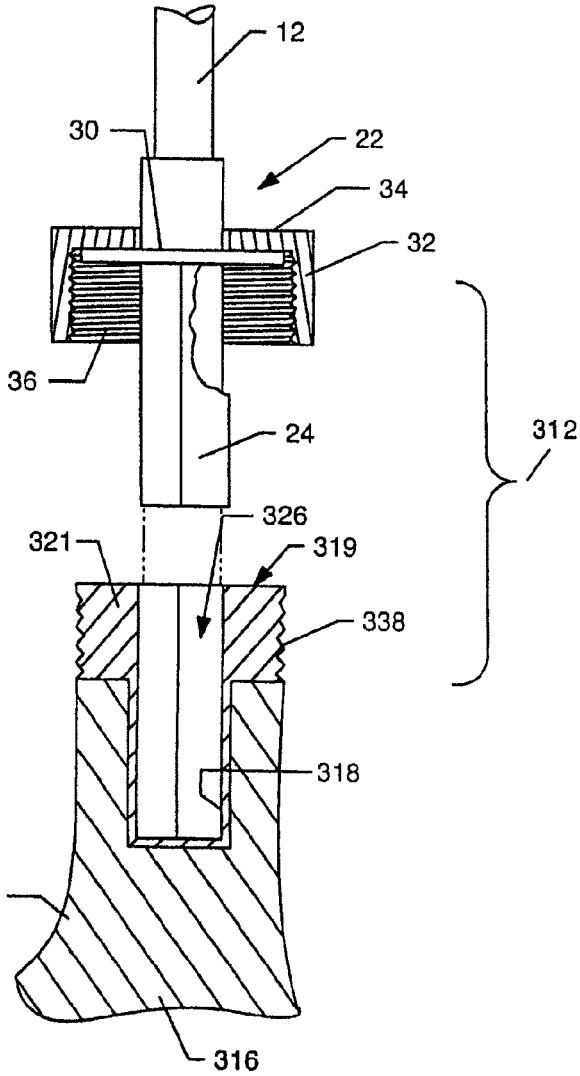
FIG. 11 is fragmented and exploded sectional view depicting a further alternative preferred form of the invention.

FIG. 11 shows another alternative preferred temporary shaft-head connection 312 of the present invention, wherein components corresponding functionally to those shown in FIGS. 1-5 are identified by common reference numerals increased by 300. This embodiment pertains to a modified hosel construction which can be tailored for use with any one of the adapter-tipped club shafts as shown and described in FIGS. 1-10.

More particularly, as shown, a golf club head 316 includes an upstanding hosel 318 formed generally at a heel end thereof, and defining an upwardly open bore 318' of conventionally round cross sectional shape. In this embodiment, the socket member is defined by an adapter socket 319 in the form of an insert sleeve which is securely mounted within the hosel bore 318', by means of epoxy adhesive or the like, wherein this adapter socket 319 defines the upwardly open hosel socket 326 having the flat-surfaced geometry such as the squared-off cross section as shown. In addition, an upper portion 321 of the adapter socket 319 overlies the axially upper end of the hosel 318 and incorporates the external male thread 338 thereon.

FIG. 11 further shows an adapter-tipped club shaft such as the shaft 12 with the adapter insert 22 and associated compression nut 32 for quick and easy assembly with the modified hosel construction. In this regard, as shown, the adapter tip 24 is slide-fit received into the hosel socket 326 to prevent relative shaft-head rotation, and the compression nut 32 threadably engages with the threaded upper portion 321 of the adapter socket 319 to firmly retain the thrust flange 30 and thereby prevent axial separation of the shaft-head components. One important aspect of the modified hosel construction as shown in FIG. 11 is that the male thread 338 can be formed on the adapter socket 319 easier than thread formation directly onto the club head hosel 318. Persons skilled in the art will recognize and appreciate that the specific shape of the hosel insert sleeve 319 can be modified for mechanical compatibility with any one of the adapter-tipped club shafts shown and described herein.

Figure 12:
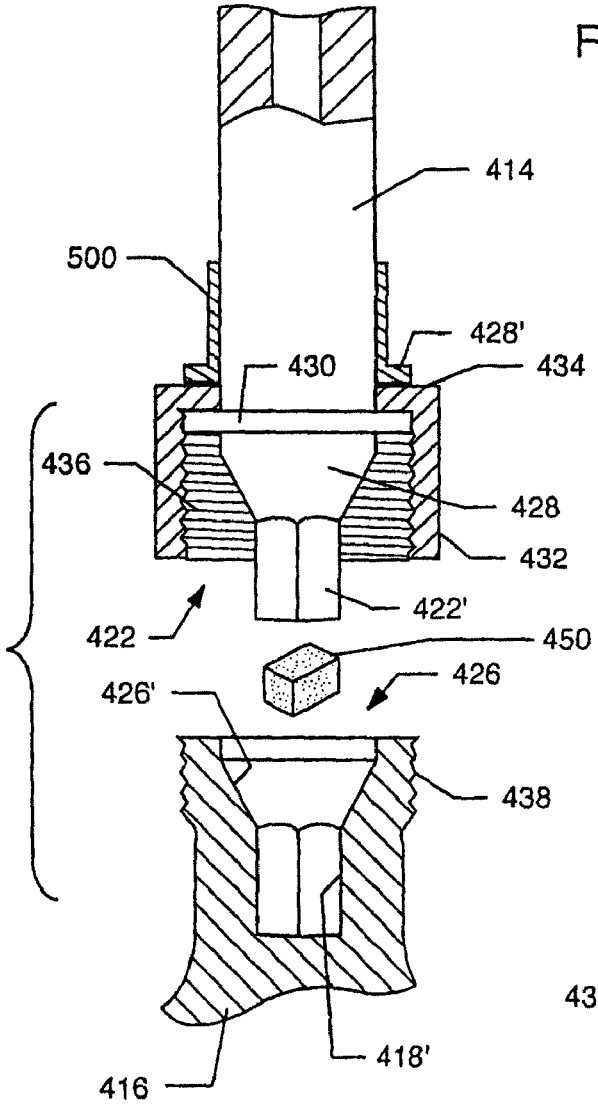
FIG. 12 is a fragmented and exploded sectional view similar to FIG. 11, but showing still another alternative preferred embodiment of the invention.
Figure 13:
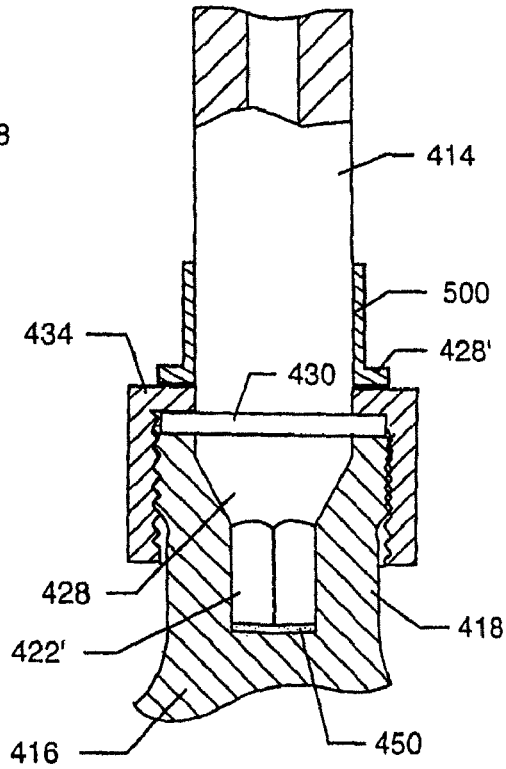
FIG. 13 is a fragmented sectional view corresponding to FIG. 12, and illustrating the golf club shaft and golf club head in assembled relation.

FIGS. 12-13 illustrate another alternative preferred embodiment of the invention, wherein components corresponding functionally to those shown in FIGS. 1-5 are identified by common reference numerals increased by 400. As shown, the golf club head 416 includes the hosel 418 at the heel end thereof and defining the upwardly open hosel socket 426 for receiving the adapter insert 422 at the tip end of the golf club shaft 414. In this version, the hosel socket 426 includes a lower flat-surfaced base segment 418' which merges with an upper tapered entry segment 426'.

The adapter insert 422 on the club shaft 414 comprises a flat-surfaced adapter tip 422' for mating slide-fit reception into the flat-surfaced base segment 418' of the hosel socket, in combination with a tapered transition zone 428 for seated and preferably friction fit or binding engagement with the upper tapered entry segment 426' of the hosel socket. A compression nut 432 includes female threads 436 for thread-on engagement with male threads on the hosel 418, with a thrust shoulder 434 on the compression nut 432 urging a thrust flange 430 into firm seated engagement with a thrust seat defined by an axially upper end of the hosel 418. As shown, this thrust flange 430 is formed at the axially upper end of the tapered transition segment zone 428, preferably integrally therewith, with the lower end of the club shaft 414 secured within the adapter insert 422 by means of epoxy attachment or the like.

The adapter insert 422 may additionally include a spring element 450 such as a block of compressible foam, such as a urethane foam member or the like, for placement into the bottom or base end of the hosel socket prior to insertion of the adapter tip 422'. This spring element 450 is tightly compressed within the hosel socket when the adapter tip 422' is seated therein and locked in place by means of thread-on attachment of the compression nut 432. Importantly, the spring element 450 provides a reaction force acting on the adapter tip 422' to assist in holding the adapter tip 422' tightly and securely in position, substantially without wobble or looseness. While the spring element 450 is shown in the embodiment of FIGS. 12-13, it will be recognized and understood that the spring element 450 may be used in any one or all of the embodiments of the invention shown and described herein.

When it is desired to disassemble the club head 416 from the club shaft 414, the compression nut 432 is unthreaded relative to the male threads 438 on the hosel 426. A backstop flange 428' is carried by the club shaft at an axial location slightly above the compression nut, so that the thrust shoulder 434 on the nut 432 engages the backstop flange 428' to axially push and separate the club shaft from the hosel 426. In other words, the engagement of the nut shoulder 434 with the backstop flange 428' overcomes the binding or friction fit engagement of the tapered transition zone 428 with the hosel, to permit relatively quick and easy shaft-head separation. As shown, this backstop flange 428' may be formed at a lower end of a backstop sleeve 500 mounted onto the club shaft 414 by means of an epoxy attachment or the like.

A variety of further modifications and improvements in and to the improved temporary shaft-component connection for a golf club of the present invention will be apparent to those persons skilled in the art. Accordingly, no limitation on the invention is intended by way of the foregoing description and accompanying drawings, except as set forth in the appended claims.

I claim:

1. An adapter for connecting a golf club shaft with golf club head, the adapter comprising:

a body member including a first end and a second end opposite the first end, wherein the first end defines an opening for receiving a golf club shaft and the second end defines an exterior surface having plural rotation-inhibiting sides;

a thrust flange provided along the body member between the first end and the second end;

a connection means for connecting the body member with a golf club head, wherein the connection means further defining a thrust shoulder for engaging the thrust flange; and an adapter socket for fixedly engaging with a golf club head, wherein the adapter socket includes a first end and a second end opposite the first end, wherein the first end of the adapter socket defines an opening for releasably receiving and engaging the exterior surface of the second end of the body member in a non-rotatable manner and the second end of the adapter socket includes exterior surfaces for fixedly engaging within a hosel portion of the golf club head, wherein said shaft is able to extend within said hosel portion.

2. An adapter according to claim 1, wherein the thrust flange is integrally formed as part of the body member.

3. An adapter according to claim 1, wherein the first end of the adapter socket includes structures that engage the connection means.

4. An adapter according to claim 3, wherein the connection means includes internal threads that engage external threads provided on the adapter socket.

5. An adapter according to claim 1, wherein the rotation-inhibiting sides of the exterior surface of the body member include plural flat sides.

6. An adapter according to claim 1, wherein the engagement between the opening of the adapter socket and the exterior surface of the second end of the body member is configured to prevent rotation between the shaft and the golf club head.

7. A golf club, comprising:

a club head;

a shaft; and an adapter for releasably connecting the club head with the shaft, wherein the adapter includes:

a body member having a first end and a second end opposite the first end, wherein the first end defines an opening into which the shaft is fixedly engaged, and wherein the second end defines an exterior surface having plural rotation-inhibiting sides;

a thrust flange provided along the body member between the first end and the second end;

a connection means for releasably connecting the body member with the club head, wherein the connection means further defining a thrust shoulder for engaging the thrust flange; and an adapter socket fixedly engaged with the club head, wherein the adapter socket includes a first end and a second end opposite the first end, wherein the first end of the adapter socket defines an opening for releasably receiving and engaging the exterior surface of the second end of the body member in a non-rotatable manner and the second end of the adapter socket includes exterior surfaces that fixedly engage a hosel portion of the club head, wherein said shaft is able to extend within said hosel portion.

8. A golf club according to claim 7, wherein the thrust flange is integrally formed as part of the body member.

9. A golf club according to claim 7, wherein the exterior surface of the adapter socket includes structures for releasably engaging the connection means.

10. A golf club according to claim 7, wherein the exterior surface of the adapter socket includes threads for engaging threads provided at the second end of the connection means.

11. A golf club according to claim 7, wherein the adapter socket includes interior surfaces that engage the exterior surface of the second end of the body member in a non-rotatable manner.

12. A golf club according to claim 7, wherein the rotation-inhibiting sides of the body member include plural flat sides.

13. A golf club according to claim 7, wherein the club head is a wood-type golf club head.

14. A golf club according to claim 7, wherein the connection means includes a compression nut, wherein the connection between the compression nut and the first end of the adapter socket is configured to retain the thrust flange and prevent axial separation of the shaft and club head.

* * * * *